US006966541B2

(12) United States Patent
Dzunda et al.

(10) Patent No.: US 6,966,541 B2
(45) Date of Patent: Nov. 22, 2005

(54) HYDRAULIC LIFTING ASSEMBLY AND METHOD

(75) Inventors: Jason Miles Dzunda, Hobart, IN (US); John Francis Nolan, Latham, NY (US); Andrew John Tomko, Glenville, NY (US)

(73) Assignee: General Electric Company, Schenectady, NY (US)

( * ) Notice: Subject to any disclaimer, the term of this patent is extended or adjusted under 35 U.S.C. 154(b) by 118 days.

(21) Appl. No.: 10/421,845

(22) Filed: Apr. 24, 2003

(65) Prior Publication Data

US 2004/0211948 A1 Oct. 28, 2004

(51) Int. Cl.[7] ..... B66F 3/24
(52) U.S. Cl. ..... 254/93 R; 254/89 H
(58) Field of Search ..... 254/93 R, 89 H, 254/133 R, 134; 29/252

(56) References Cited

U.S. PATENT DOCUMENTS 5,692,731 A * 12/1997 Beauchamp ..... 254/124
5,769,394 A * 6/1998 Yirmiyahu et al. ..... 254/93 R
5,810,333 A * 9/1998 Hickerson et al. ..... 254/93 R
6,088,904 A 7/2000 Keck et al.
6,746,183 B1 * 6/2004 Sullivan ..... 405/272
2004/0149969 A1 * 8/2004 Cardona ..... 254/93 R

* cited by examiner

*Primary Examiner*—Lee D. Wilson

(74) *Attorney, Agent, or Firm*—Nixon & Vanderhye PC

(57) ABSTRACT

An assembly for lifting and supporting a journal body with respect to a stationary body including: a support bracket for being secured to said stationary body; an elongated support member to engage and support a bottom facing surface of the journal body; first and second support studs operatively coupled at a distal end thereof to a respective longitudinal end of said elongated support member and adjustably coupled at the proximal end thereof via a respective lift assembly to said support bracket, wherein each said lift assembly comprises a hydraulic cylinder operatively coupled to said proximal end of said support stud so as to selectively determine a position of said support stud with respect to support bracket thereby to selectively adjust and determine a position of said journal body with respect to said stationary body.

20 Claims, 4 Drawing Sheets

HYDRAULIC LIFTING ASSEMBLY AND METHOD

BACKGROUND OF THE INVENTION

The present invention relates to an assembly and method for lifting and supporting the generator field in the stator frame to allow the insertion or removal of the hydrogen seal casing, inner oil deflector, field body shoe, skid pan, and other generator or field hardware.

With reference to FIGS. 1 and 2, conventionally, the generator field 10 is positioned and moved using support studs 12 installed through a support assembly with spherical nuts 14, in order to raise and lower the generator field. More specifically, a support bracket, sometimes as referred to as an eyebrow 16, is bolted to the stator frame 18 with bolts 20. The bracket has spaced bores 22 and spherical receptacles 24 for receiving the support studs 12 and spherical nuts 14, respectively. The distal end 26 of each support stud is secured to a respective clevis 28 coupled to a respective longitudinal end of a cable 30 that extends below the generator field 10. As illustrated, a protective journal shim 32 is provided between the cable 30 and the generator field 10. The spherical nuts 14 are threaded to the support studs 12 for selectively adjusting their position relative to the eyebrow 16 to in turn adjust the position of the cable and the generator field supported thereby. Thus, in the conventional structure, by rotating the spherical nuts 14, the position of the generator field 10 can be adjusted up and down to position and move the generator field as required.

With this conventional design, there is a significant amount of weight on each of the spherical nuts. This results in a large friction force and makes it difficult to turn the nuts to adjust the stud position. Indeed, large impact wrenches have to be utilized along with torque multipliers to turn the nuts. As a result, in most cases, the station crane must used to elevate the field, removing weight from the studs/nuts so that the required length adjustment can be made. Thus, the current system is labor intensive and difficult to perform. It would be desirable to eliminate crane usage and make the process faster, easier and less labor intensive.

BRIEF DESCRIPTION OF THE INVENTION

The present invention provides an assembly and method for accurate and controllable positioning of the generator field while it is still in the stator frame. The assembly of the invention allows on-site personnel to make elevation adjustments in a much quicker, easier and safer way then the above-described conventional system. Indeed, the assembly and method of the invention eliminates crane usage at this stage of generator assembly or disassembly; shortens the duration for generator disassembly and assembly while making the adjustment safer, easier and quicker; and makes the generator field movement easier, which allows more accurate positioning.

The invention achieves these objectives by modifying the conventional design to provide for lifting via hydraulic cylinders. Thus, the invention is embodied in an assembly for lifting and supporting a journal body with respect to a stationary body comprising: a support bracket for being secured to said stationary body; an elongated support member to engage and support a bottom facing surface of the journal body; at least one hydraulic lift assembly mounted to said support bracket, each said lift assembly including a hydraulic cylinder; a support stud operatively coupled, adjacent a proximal end thereof, to each said hydraulic lift assembly; and each said support stud being operatively coupled, adjacent a distal end thereof, to said elongated support member; whereby actuation of said hydraulic cylinder selectively lifts said support stud and said support member coupled thereto, thereby to selectively lift and determine a position of said journal body with respect to said stationary body.

The invention may also be embodied in a method for lifting and supporting a journal body with respect to a stationary body comprising: securing a support bracket to said stationary body; disposing an elongated support member to engage a bottom facing surface of the journal body; mounting at least one hydraulic lift assembly to said support bracket, each said lift assembly including a hydraulic cylinder; operatively coupling a support stud, adjacent a proximal end thereof, to each said hydraulic lift assembly; operatively coupling each said support stud, adjacent a distal end thereof to said elongated support member; and selectively actuating said at least one hydraulic lift assembly to selectively raise and lower said support stud to selectively adjust and determine a position of said journal body with respect to said stationary body.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
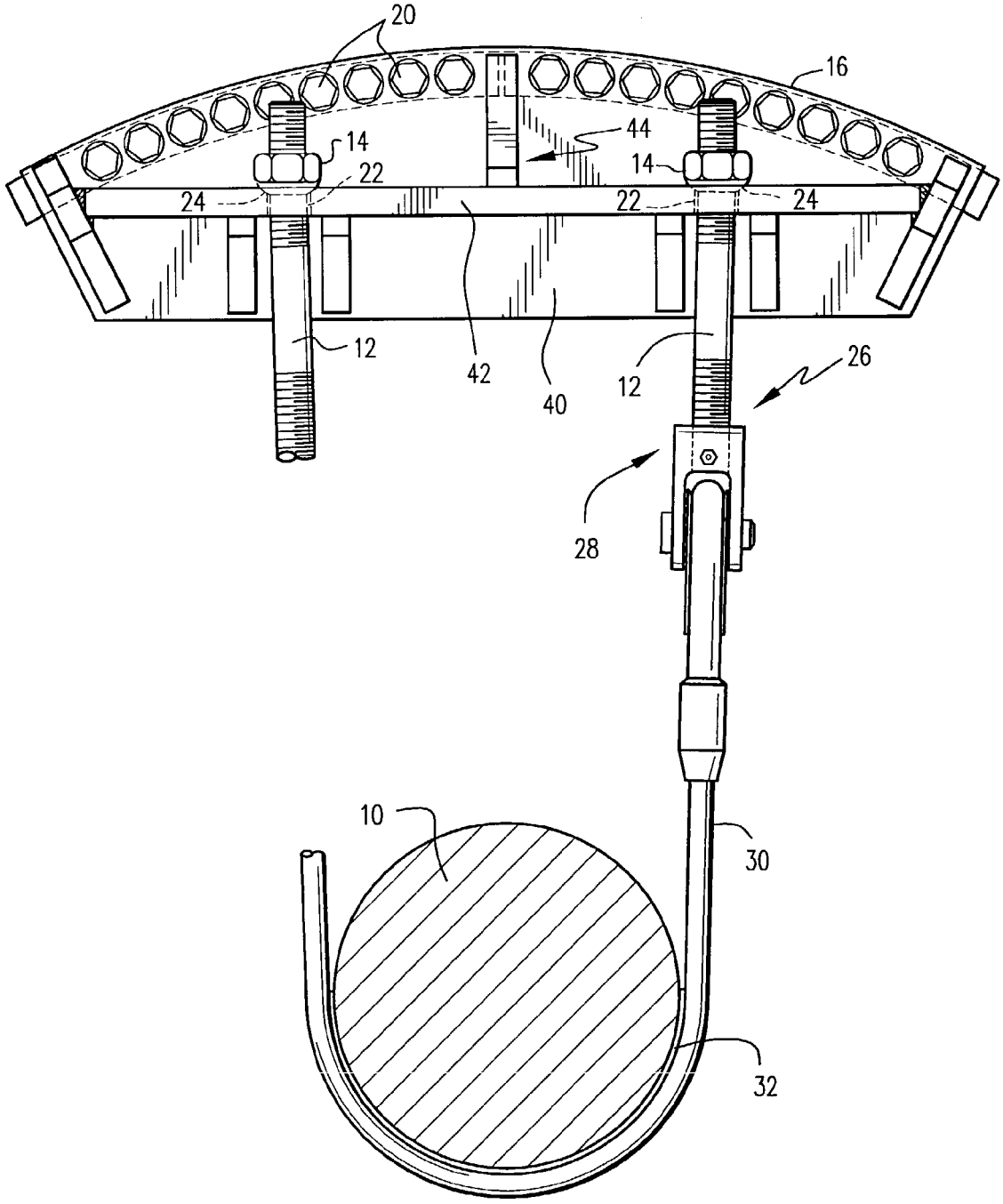
Fig.1 (PRIOR ART)
FIG. 1 is an elevational view of a conventional lift and support assembly for a generator field.

The assembly and process of the invention can be applied to any system where a journal body or core needs to be lifted and positioned or supported with respect to a stationary body, to allow the assembly and removal of associated components between the core and the stationary body. By way of non-limiting example, the assembly and process of the invention are applied to generator assemblies in which the generator field needs to be positioned with respect to the stator frame to allow for the assembly and removal of the hydrogen seal casing, inner oil deflector, seal body shoe, skid pan and/or other equipment. The assembly of the invention allows the generator field to be raised up or set down within the stator frame quickly and easily for these and any other purpose. The invention may be readily applied to any generator that presently has a rotor sling 30 and support assembly (eyebrow) rig 16 of the type generally described above with reference to FIGS. 1 and 2.

In an exemplary embodiment described hereinbelow, the lift assembly 100 of the invention is similar in some respects to the conventional lift assembly. For that reason generally corresponding parts are identified with corresponding reference numerals incremented by 100.

In an exemplary embodiment of the proposed assembly two support studs 112 are provided as in the conventional assembly, each coupled to an associated hydraulic lifting assembly. However, for ease of description, only a single hydraulic lifting assembly 100 is illustrated and described hereinbelow. Moreover, it is to be understood that in some adaptations, the advantages of the invention may be realized with a single hydraulic lifting assembly suitably coupled to a sling assembly.

Figure 3:
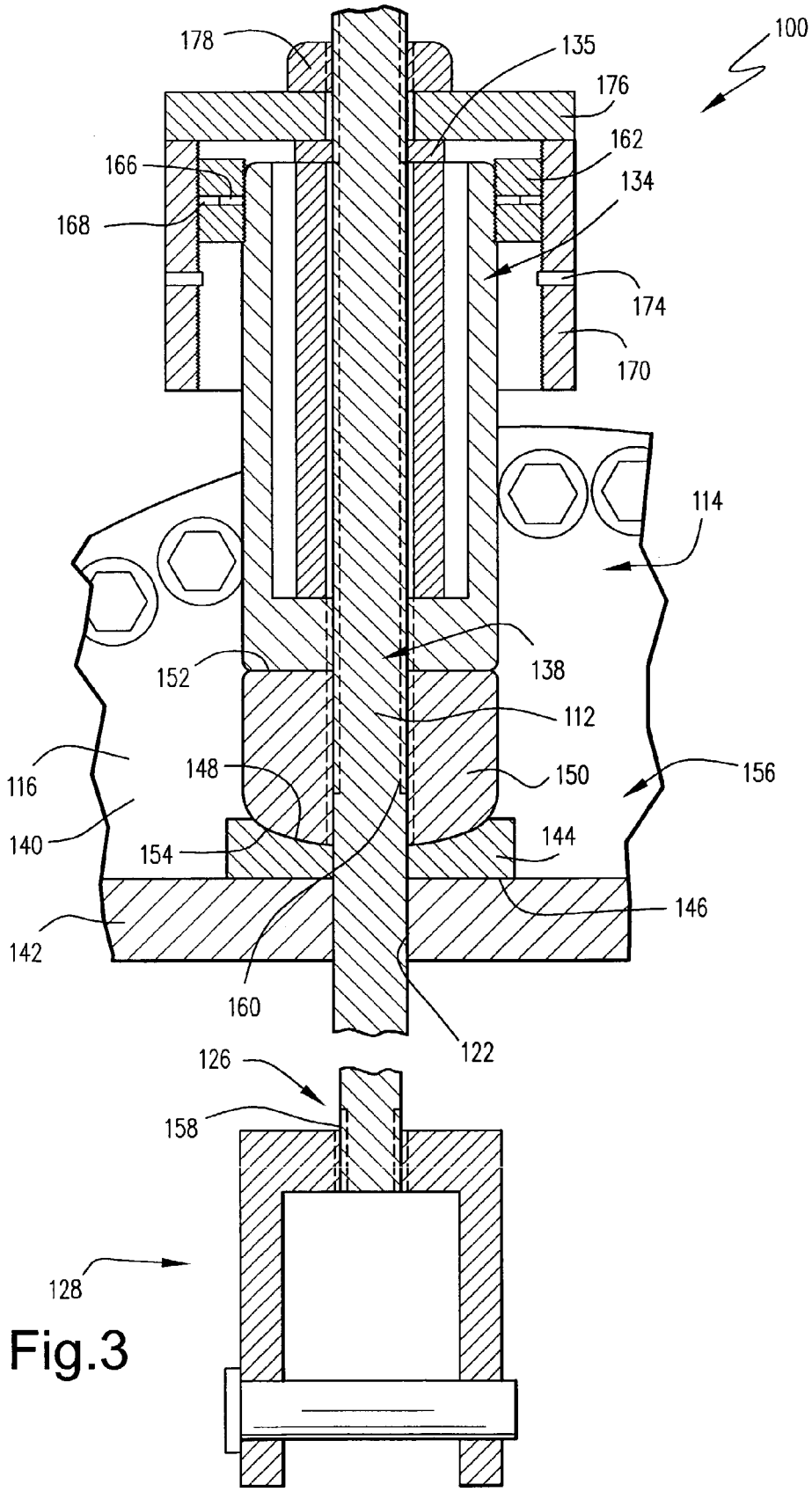
FIG. 3 is a schematic cross-sectional view of a lift and support assembly provided as an embodiment of the invention.
Figure 4:
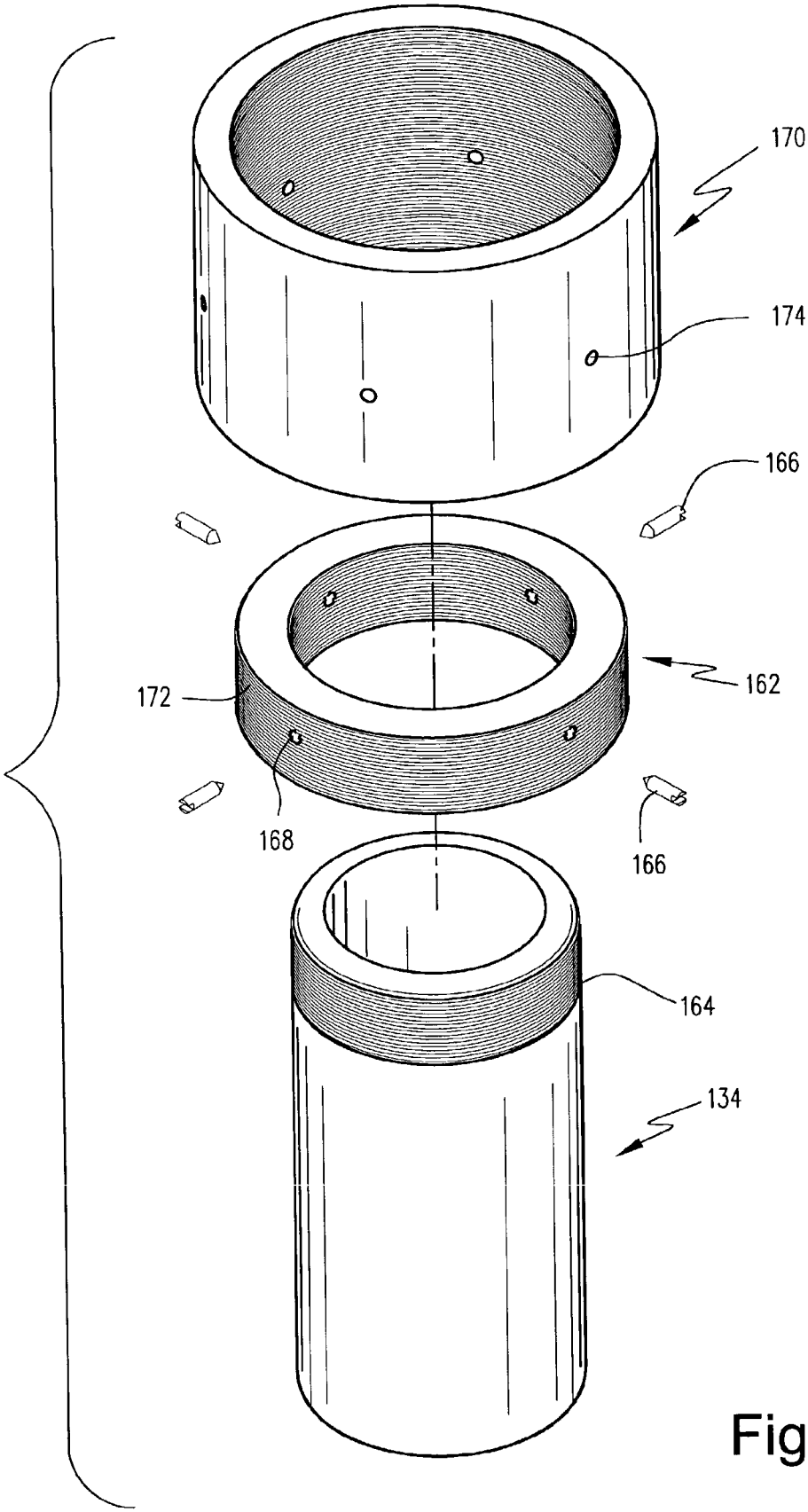
FIG. 4 is an exploded perspective view of a portion of the lift assembly of the FIG. 3 embodiment.

As mentioned above, in an embodiment of the invention, the displacement of the support studs 112 to lift the journal body (not shown in FIGS 3–4), for example, a generator field 10, with respect to a stationary body (not shown in FIG 3–4), for example a stator frame 18, is facilitated with hydraulic cylinders 134 (only one of which is shown in FIG. 3), one associated with each support stud 112. Collars, washers and nuts are secured to the hydraulic cylinder 134 and support stud 112 as set forth in greater detail below. The hydraulic cylinders can then raise and lower the respective support stud, adjusting the generator field or other journal body up and down.

Referring to FIG. 3, one of the two support studs 112 provided to support and position a core or journal body is schematically illustrated. The stud has a proximal end 138 operatively coupled to a coupling and lift assembly 114 and a distal end 126, which is operatively coupled to the sling (elongated support member) engaged with the core body. Reference will be made hereinafter, by way of example and not limitation, to the lifting and supporting of a generator field.

Figure 2:
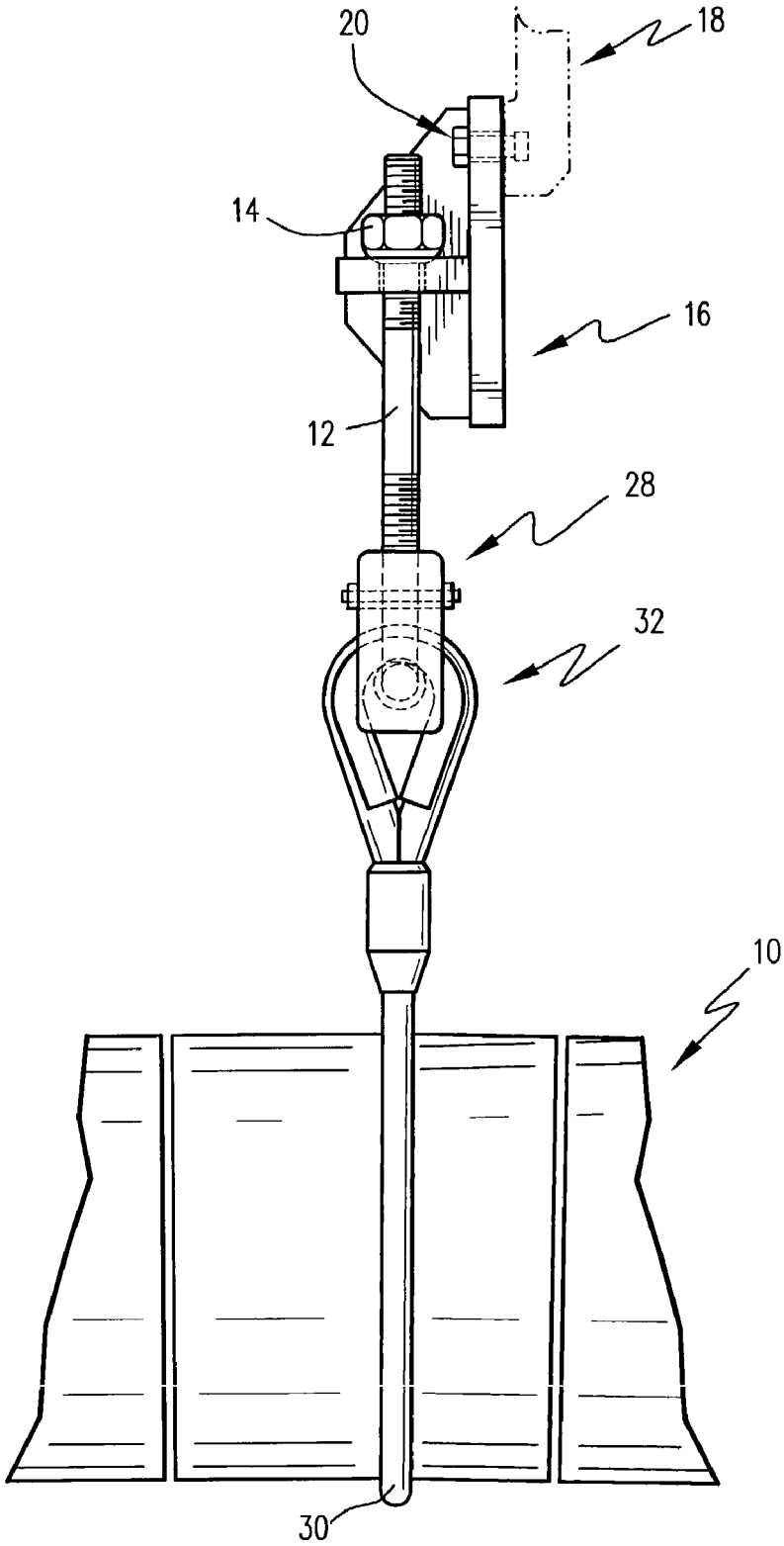
Fig.2 (PRIOR ART)
FIG. 2 is a side view, partly broken away for clarity, of the assembly of FIG. 1.

In an exemplary embodiment, the sling is comprised of a cable 30 having a support eye 34 defined at each longitudinal end, as shown in FIGS. 1 and 2 which is engaged with and supported by a respective clevis 128. Thus, in this exemplary embodiment, the support stud 112 is operatively coupled at distal end 126 thereof to the clevis 128 that in turn pivotally supports the cable 30 defining the journal body sling.

As in the conventional assembly, a support bracket or eyebrow 116 is secured, e.g., with bolts 120 to the stationary body (stator frame). As such, the support bracket 116 includes a vertical flange 140 which is secured with respect to the stator frame 18 (not shown in FIGS. 3–4) by bolts 120 and has horizontal flange 142 having bores 122 for receiving the first and second support studs 112. In an exemplary embodiment, the support bracket 116 is modified from the conventional configuration to space the support stud hole 122 away from the stator frame and the threaded portion 136 on the proximal end 138 of the support stud 112 is longer than in the conventional system, to accommodate a hydraulic cylinder 134. As in the conventional structure, supports (not shown in FIG. 3) similar to the supports 44 that extend between the vertical wall 40 and the horizontal flange 42 of the support bracket 16, extend between the vertical flange 140 and the horizontal flange 142 of the support bracket 116 to brace and reinforce the assembly.

The coupling and lift assembly 114 is advantageously supported on the support bracket 116 in a manner that allows pivotal displacement of stud 112 with respect to the support bracket 116 as required to accommodate the orientation of the cable and cleavis assemblies, which may not be perfectly vertical. To this end, a pivot support is placed between the distal end of the hydraulic cylinder 134 and the horizontal flange 142 of the support bracket.

In the illustrated embodiment the pivot assembly 156 is comprised of a pivot shoe 144 having a flat surface 146 engaging the horizontal flange 142 of the support bracket and a part spherical surface 148. The pivot assembly further includes a pivot leg 150 having a generally flat surface 152 for engaging the lift assembly components disposed thereabove and a part spherical surface 154 for engaging the part spherical surface 148 of the pivot shoe. In the illustrated embodiment, the part spherical surface of the pivot shoe is concave and the part spherical surface of the pivot leg is convex. It is to be understood that the pivot assembly of the lift assembly of the invention is not limited to the number and configuration of pivot parts illustrated and described above.

In the illustrated embodiment, the hydraulic cylinder 134 is seated directly on the pivot assembly 156. It is to be understood, however, that additional spacer structures, e.g., washers, may be interposed between the pivot assembly 156 and the hydraulic cylinder 134 as deemed necessary or desirable to vertically dispose the hydraulic cylinder 134 to minimize interference between the coupling and lift assembly 114 and the support bracket 116 and associated coupling structures 120.

The hydraulic cylinder 134 is preferably a hollow plunger cylinder so that the support stud 112 may be disposed to extend through the hydraulic cylinder. In an exemplary embodiment, the cylinder capacity is 60 tons and has e.g., a 6-inch stroke. A suitable such cylinder is available from Enerpac, as Model Number RCH-606. By way of example, that cylinder has an outside diameter of about 6.25 inches, a center hole diameter of about 2.12 inches, and a height of about 18.75 inches. When such a cylinder is utilized in the assembly of the invention, the stud 112 advantageously has an outer diameter of about 2 inches. Further, in an exemplary embodiment, the support stud has a length on the order of 48 inches, the distal portion 126 being threaded, as at 158, along approximately 4 inches of its length and the proximal end 138 of the stud being threaded, as at 160, along approximately 28 inches of its length.

In an exemplary embodiment, the pivot leg 150 has an outer diameter of about 6 inches and a height of about 4 inches and the pivot shoe 144 has an outer diameter of about 7 inches. To accommodate relative pivoting movement of the support stud, in an exemplary embodiment, the inner diameters of the pivot shoe and the pivot leg are about 3 inches.

In the illustrated embodiment, the coupling and lift assembly 114 for the support stud 112 includes a stop ring 162 which is threadedly engaged with the hydraulic cylinder 134, which is itself threaded as at 164 on the exterior surface of its proximal end, and then locked with respect thereto by set screws 166 threaded through radial bores 168 defined at spaced locations about the circumference of the stop ring 162. A stop collar 170 is then threadably engaged to a threaded outer surface 172 of the stop ring 162. Radial turning holes 174 are defined at spaced locations about the circumference of the stop collar 170 to facilitate proper positioning of the stop collar, as described in greater detail below. A stop washer 176 is seated atop the stop collar 170 and has an outer diameter generally corresponding to that of the stop collar. The stop collar may be adjusted with respect to the stop ring/hydraulic cylinder to determine the position of the stop washer 176 on or above the piston 135 of the hydraulic cylinder. The support stud 112 is threaded through the lift assembly 114 and a hex nut 178 is threaded to the support stud 112, operatively coupling support stud to the coupling and lift assembly 114. As will be appreciated, when the hydraulic cylinder 134 is actuated to extend piston 135, stop washer 176 and nut 178 seated thereon are lifted by the piston 135, thereby lifting the associated support stud 112 and sling coupled thereto. When the hydraulic cylinder is (de) actuated to withdraw piston 135, the stop washer will be selectively lowered until it engages the stop collar 170, so that the stop collar 170 defines the end of the downward stroke of the support stud 112.

As can be seen in FIG. 3, the stop collar 170 has a length that is about 3 times that of the stop ring 162 to determine with greater flexibility the supported position of the support stud. In the illustrated embodiment, the stop ring 162 has a length of about 2 inches and an outer diameter of about 8.375 inches, whereas the stop collar 170 has a length on the order of about 6 inches. The inner diameter of the stop ring 162 is sized and threaded to mate with the threads on the outer surface of the hydraulic cylinder 134.

The hydraulic lifting assembly 100 of the invention is set up as follows. The stop ring 162 is threaded onto the hydraulic cylinder 134 and the set screws 166 are installed to lock the stop ring 162 with respect to the cylinder 134. As will be understood, the setscrews help prevent rotation of the stop ring with respect to the cylinder. The stop collar 170 is then threaded onto the stop ring. The support bracket or eyebrow 116 is installed on the generator (stator) frame (not shown in FIGS. 3 and 4), e.g. with bolts 120. A hydraulic cylinder 134, pivot leg 150 and pivot shoe 144 for each stud is then seated onto the support bracket 116, concentrically aligned to a respective stud hole 122. If required, additional washers or spacers may be added between the base of the hydraulic cylinder 134 and the pivot leg 150 in order to prevent interference between the support bracket 116 and/or bolts 120 and the stop collar 170, as mentioned above.

Next, the large stop washer 176 is placed on top of the stop collar 170. The support stud 112 is threaded through the stop washer 176, hydraulic cylinder 134, pivot leg 150, pivot shoe 144, and support bracket 116, and. The hex nut 178, threadably engaged with the stud 112, prevents the stud from sliding through the hydraulic cylinder. The clevises 128 are then attached to the distal end 126 of the studs. Using the sling and clevis hardware (not shown in FIGS. 3 and 4), the sling is disposed around the generator field and secured at each longitudinal end to the respective clevis. The hex nuts are then adjusted to remove any excess slack in the sling.

Hydraulic lines (not shown) are then attached to the cylinders 134 at one end and operatively coupled at the opposite end to a suitable electric/hydraulic pumping system (not shown). T-fitting or a suitable hydraulic manifold may b provided to couple the hydraulic lines to the pumping system. The hydraulic cylinders are both actuated at the same time through the supply lines whereby the generator field may be lifted and lowered via the hydraulic cylinders.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An assembly for lifting and supporting a journal body with respect to a stationary body comprising:

a support bracket for being secured to said stationary body;

an elongated support member to engage and support a bottom facing surface of the journal body;

at least one hydraulic lift assembly mounted to said support bracket, each said lift assembly including a hydraulic cylinder;

a support stud operatively coupled, adjacent a proximal end thereof, to each said hydraulic lift assembly; and each said support stud being operatively coupled, adjacent a distal end thereof, to said elongated support member;

whereby actuation of said hydraulic cylinder selectively lifts said support stud and said support member coupled thereto, thereby to selectively lift and determine a position of said journal body with respect to said stationary body, wherein said support stud extends through a bore defined longitudinally of said hydraulic cylinder, said support stud being selectively supported by, so as to move with, a piston of said hydraulic cylinder.

2. An assembly as in claim 1, further comprising a pivot assembly disposed between said support bracket and said hydraulic cylinder whereby said hydraulic cylinder is pivotally seated on said support bracket.

3. An assembly as in claim 2, wherein said pivot assembly comprises a pivot shoe having a flat surface for engaging said support bracket and a part spherical surface; and a pivot leg having a flat surface for engaging said hydraulic cylinder and a part spherical surface complimentary to said part spherical surface of said pivot shoe.

4. An assembly as in claim 3, wherein a bore is defined through said pivot shoe and pivot leg for receiving said support stud.

5. An assembly as in claim 1, wherein said lift assembly further comprises a washer and a stop collar, said washer selectively engaging said stop collar to limit downward displacement of said support stud with respect to said stop collar.

6. An assembly as in claim 1, wherein said lift assembly further comprises a stop ring having a threaded inner circumference and a threaded outer circumference, said stop ring being threadably engaged to a proximal end of said hydraulic cylinder.

7. An assembly as in claim 6, further comprising a plurality of radial bores in each said stop ring, each said bore being threaded to selectively receive a set screw for locking said stop ring with respect to said hydraulic cylinder.

8. An assembly as in claim 6, wherein said lift assembly further comprises a washer and a stop collar, said stop collar having a threaded inner circumference and sized and configured to threadably engage said outer circumference of said stop ring, said washer selectively engaging said stop collar to limit downward displacement of said support stud with respect to said stop collar.

9. An assembly as in claim 8, wherein said stop collar includes a plurality of radial bores, defining turning holes for facilitating longitudinal displacement of said stop collar with respect to said stop ring by rotation of said stop collar.

10. An assembly as in claim 1, wherein said elongated support member is flexible so as to engage and support said bottom facing surface of the journal body.

11. A method for lifting and supporting a journal body with respect to a stationary body comprising:

securing a support bracket to said stationary body;

disposing an elongated support member to engage a bottom facing surface of the journal body;

mounting at least one hydraulic lift assembly to said support bracket, each said lift assembly including a hydraulic cylinder;

operatively coupling a support stud, adjacent a proximal end thereof, to each said hydraulic lift assembly;

operatively coupling each said support stud, adjacent a distal end thereof to said elongated support member; and selectively actuating said at least one hydraulic lift assembly to selectively raise and lower said support stud to selectively adjust and determine a position of said journal body with respect to said stationary body, wherein said operatively coupling to said hydraulic lift assembly comprises disposing said support stud to extend through a bore defined longitudinally of said hydraulic cylinder, said support stud being selectively supported by, so as to move with, a piston of said hydraulic cylinder.

12. A method as in claim 11, wherein said hydraulic lift assembly is seated on said support bracket.

13. A method as in claim 12, wherein a pivot assembly is interposed between said hydraulic cylinder and said support bracket, whereby said hydraulic lift assembly is pivotally seated on said support bracket.

14. A method as in claim 12, wherein said hydraulic lift assembly further comprises a washer supporting said support stud and a stop collar mounted to said hydraulic cylinder, said washer engaging said stop collar to limit downward displacement of said support stud with respect to said hydraulic cylinder.

15. A method as in claim 12, wherein said stop collar is vertically adjustable with respect to said hydraulic cylinder.

16. A method as in claim 12, wherein there are first and second hydraulic lift assemblies and first and second support studs operatively coupled thereto, and wherein said elongated support member comprises a flexible sling extending under said journal body to lift and support said journal body upon actuation of said hydraulic cylinders.

17. A method as in claim 11, wherein said elongated support member comprises a cable and wherein said operatively coupling comprises pivotally coupling said cable to said support stud.

18. An assembly for lifting and supporting a journal body with respect to a stationary body comprising:

a support bracket for being secured to said stationary body;

an elongated support member to engage and support a bottom facing surface of the journal body;

at least one hydraulic lift assembly mounted to said support bracket, each said lift assembly including a hydraulic cylinder;

a support stud operatively coupled, adjacent a proximal end thereof, to each said hydraulic lift assembly;

each said support stud being operatively coupled, adjacent a distal end thereof, to said elongated support member, whereby actuation of said hydraulic cylinder selectively lifts said support stud and said support member coupled thereto, thereby to selectively lift and determine a position of said journal body with respect to said stationary body; and further comprising a pivot assembly disposed between said support bracket and said hydraulic cylinder whereby said hydraulic cylinder is pivotally seated on said support bracket.

19. An assembly as in claim 18, wherein said pivot assembly comprises a pivot shoe having a flat surface for engaging said support bracket and a part spherical surface; and a pivot leg having a flat surface for engaging said hydraulic cylinder and a part spherical surface complimentary to said part spherical surface of said pivot shoe.

20. An assembly as in claim 18, wherein said lift assembly further comprises a washer and a stop collar, said washer selectively engaging said stop collar to limit downward displacement of said support stud with respect to said stop collar.

* * * * *